US007017955B1

(12) United States Patent
Chiang

(10) Patent No.: US 7,017,955 B1
(45) Date of Patent: Mar. 28, 2006

(54) DRAW LATCH HAVING KICK-OUT CATCH

(75) Inventor: Ching Hua Chiang, Taichung Industrial Zone (TW)

(73) Assignee: Asmith Manufacturing Company, Taichung (TW)

( * ) Notice: Subject to any disclaimer, the term of this patent is extended or adjusted under 35 U.S.C. 154(b) by 0 days.

(21) Appl. No.: 10/980,738

(22) Filed: Nov. 3, 2004

(51) Int. Cl.
*E05C 19/12* (2006.01)

(52) U.S. Cl. ..... 292/113; 292/247; 292/256.69; 292/DIG. 49; 403/322.4

(58) Field of Classification Search ..... 292/113, 292/247, 756.69, DIG. 49; 24/24, 70, 310, 24/170; 403/322.4
See application file for complete search history.

(56) References Cited

U.S. PATENT DOCUMENTS 2,904,141 A * 9/1959 Henrichs ..... 403/321
3,428,348 A * 2/1969 Swanson ..... 292/113
3,519,298 A * 7/1970 Gley et al. ..... 292/113
3,534,992 A * 10/1970 Swanson ..... 292/113
3,602,723 A * 8/1971 Swanson ..... 292/113
3,831,224 A * 8/1974 MacMaster et al. ..... 24/68 T
3,936,082 A * 2/1976 Swanson ..... 292/113
4,218,081 A * 8/1980 Johnson ..... 292/66
4,318,557 A * 3/1982 Bourne et al. ..... 292/113
4,602,812 A * 7/1986 Bourne ..... 292/113
5,478,125 A 12/1995 Gromotka ..... 292/67
5,620,212 A * 4/1997 Bourne et al. ..... 292/113
6,767,157 B1 * 7/2004 Gilliland et al. ..... 403/374.1

* cited by examiner

*Primary Examiner*—Brian E. Glessner
*Assistant Examiner*—Mark Williams
(74) *Attorney, Agent, or Firm*—Charles E. Baxley

(57) ABSTRACT

A draw latch includes a base member and a keeper secured to two panel members, a lever having two side flaps rotatably attached to the base member and having an actuator extended from one end, a cam member and a bracket rotatably attached to the side flaps of the lever. The bracket includes an end panel for threading to a catch which has a hook for engaging with the keeper. The cam member includes two side plates extended from a bottom plate and each having a horizontal surface for engaging with the bracket, to allow the actuator to actuate onto the cam member and then to actuate onto the bracket in a direction perpendicular to the bracket via the horizontal surfaces of the cam member.

6 Claims, 4 Drawing Sheets

DRAW LATCH HAVING KICK-OUT CATCH

BACKGROUND OF THE INVENTION

1. Field of the Invention

The present invention relates to a draw latch, and more particularly to a draw latch having a catch that may be kicked out by a lever with less force.

2. Description of the Prior Art

Various kinds of typical catches or locks or latches, such as draw latches have been developed and provided for attaching to two panel members or elements of doors, windows, or the like, and for easily and quickly locking or latching the panel members of the doors or the windows or the like together, and comprise a base member for attaching to one of the door panels or windows, and a catch member for latching or catching to the other door panel or window.

For example, U.S. Pat. No. 5,478,125 to Gromotka discloses one of the typical draw latches comprising a base attached to a panel member of the doors or windows, a catch member pivotally or rotatably attached to the base, and a lever also pivotally or rotatably attached to the base with a pin and engageable with the catch, to selectively actuate the catch and to disengage the catch from the other panel member of the doors or windows.

However, when the lever is rotated relative to the base to engage with and to actuate or to rotate the catch relative to the base, the lever applies a force against the catch in an actuating direction parallel to the catch, but may not apply a force against the catch in an actuating direction perpendicular to the catch, in addition, the lever is acted onto the catch at an end position on the other side of the pin, such that the lever may have to apply a greater force to kick out the catch, and such that the lever may not be used to easily rotate the catch relative to or away from the base.

The present invention has arisen to mitigate and/or obviate the afore-described disadvantages of the conventional draw latches.

SUMMARY OF THE INVENTION

The primary objective of the present invention is to provide a draw latch including a catch that may be kicked out by a lever which may act or actuate onto the catch in both directions parallel to and perpendicular to the catch, to easily disengage the catch from a panel member and to separate the catch from the panel member with less force.

In accordance with one aspect of the invention, there is provided a draw latch for attaching to and for latching a first panel member and a second panel member together, the draw latch comprises a base member for securing to the first panel member, a keeper for securing to the second panel member, a lever rotatably attached to the base member with a pivot axle, the lever including two side flaps extended therefrom and parallel to each other and each having a hole formed therein for receiving the pivot axle, each of the side flaps includes a first end having an orifice formed therein for receiving a pivot shaft therein, and having an actuator extended from the first end thereof, a cam member and a bracket rotatably attached to the side flaps of the lever with the pivot shaft, to allow the cam member and the bracket to be rotated relative to the lever. The bracket includes a first end having two ears extended therefrom for rotatably attaching to the side flaps of the lever with the pivot shaft, and includes a second end having an end panel extended therefrom and having a screw hole formed in the end panel, a catch includes a threaded shank threaded to the screw hole of the end panel, and including a hook provided on one end thereof for engaging with the keeper of the second panel member, and the cam member includes a bottom plate, and two side plates extended from the bottom plate and each having an aperture formed in a corner area thereof, and each having a horizontal surface parallel to the bottom plate, and the horizontal surfaces of the side plates of the cam member are engageable with the bracket, to allow the actuator of the lever to actuate onto the cam member and then to actuate onto the bracket in a direction perpendicular to the bracket via the horizontal surfaces of the cam member.

The ears of the bracket are preferably rounded to prevent the ears of the bracket from being rotated or actuated by the lever. The first end of each of the side flaps includes a curved surface formed therein.

The catch includes a lock nut threaded onto the threaded shank and engageable with the end panel of the bracket, for solidly locking the threaded shank of the catch to the bracket. The bracket includes an opening formed therein for allowing the threaded shank of the catch to be seen through the opening of the bracket. The actuator of the lever is preferably offset from the side flaps thereof for effectively actuating onto the cam member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
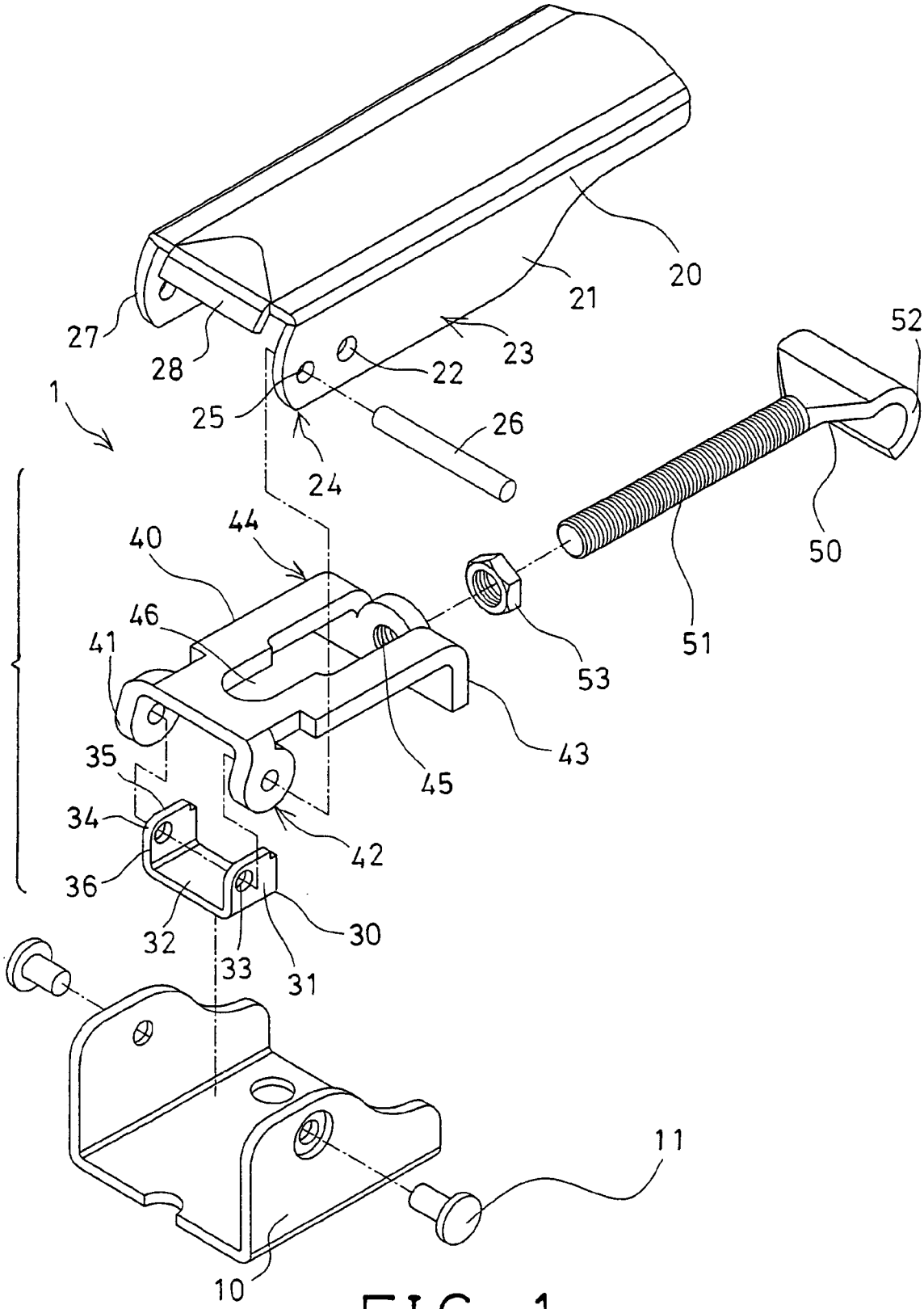
FIG. 1 is an exploded view of a draw latch in accordance with the present invention.
Figure 2:
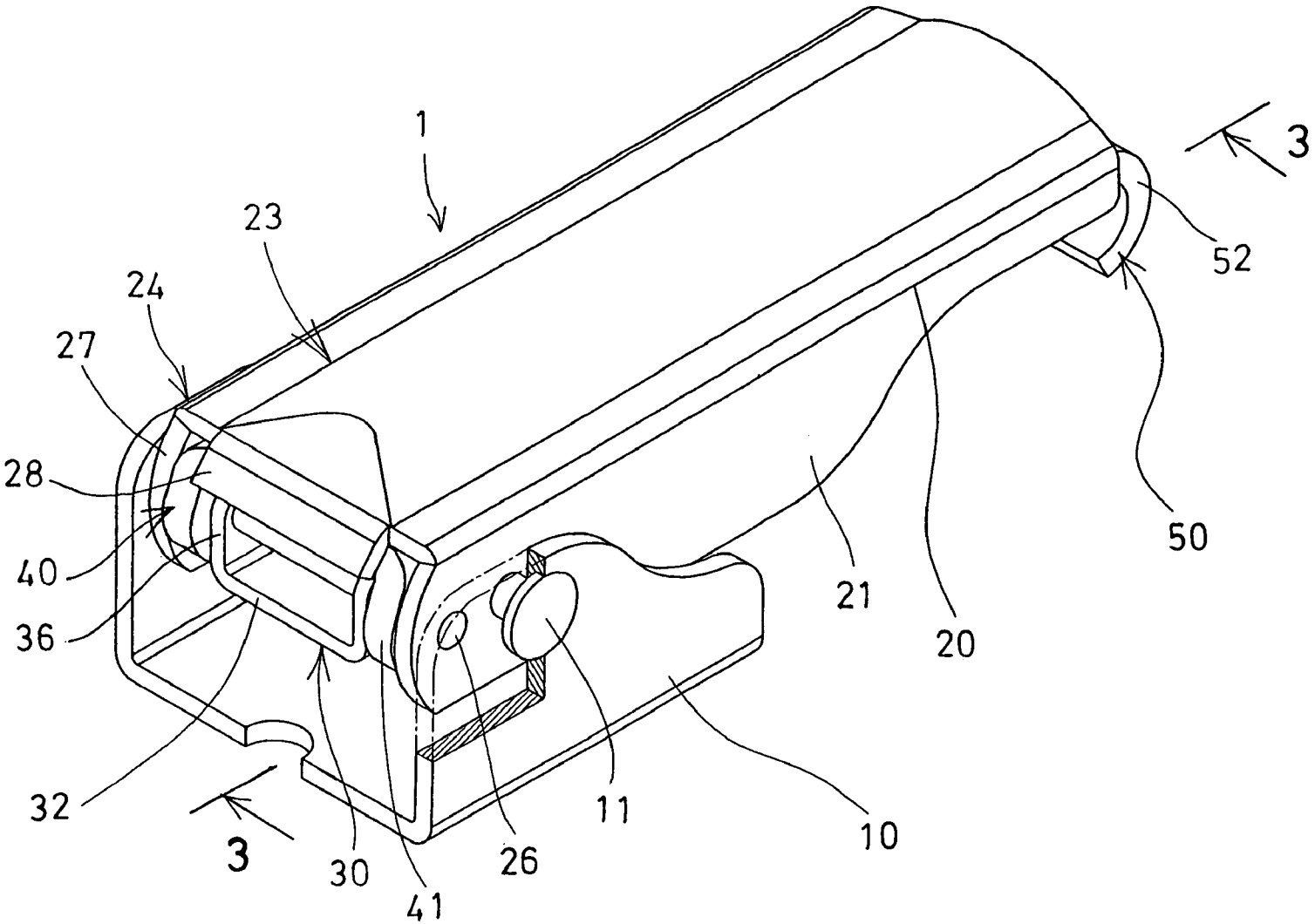
FIG. 2 is a perspective view of the draw latch.
Figure 3:
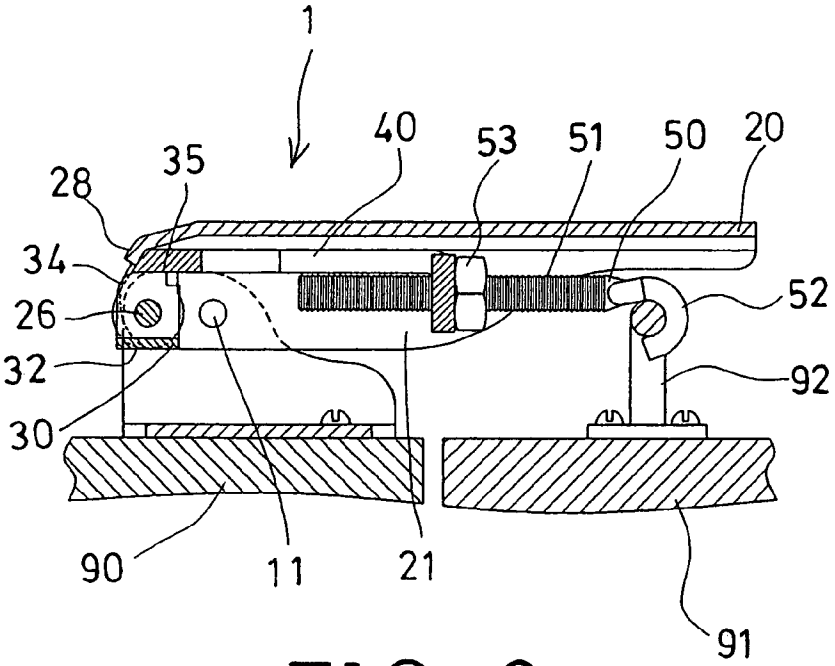
FIG. 3 is a partial cross sectional view of the draw latch, taken along lines 3—3 of FIG. 2.

Referring to the drawings, and initially to FIGS. 1–3, a draw latch 1 in accordance with the present invention is provided for attaching to two panel members 90, 91 of typical doors, windows, cabinets, boxes, or the like, and for detachably securing or locking or latching the panel members 90, 91 together. For example, the draw latch 1 comprises a base member 10 for securing to one of the panel members 90 with fasteners (not shown) or the like. The other panel member 91 includes a typical U-shaped keeper 92 secured thereto for engaging with the draw latch 1, and for allowing the draw latch 1 to be used to latch the panel members 90 and 91 together.

The draw latch 1 further includes a lever 20 pivotally or rotatably attached to the base member 10 with a pivot axle 11. For example, the lever 20 includes two side flaps 21 extended therefrom and parallel to each other, and each having a hole 22 formed in an intermediate portion 23 thereof and located close to one end 24 thereof, for receiving the pivot axle 11. Each of the side flaps 21 includes an orifice 25 formed in the end 24 thereof, for receiving a pivot shaft 26 therein, and a curved surface 27 formed in the end 24 thereof, and an actuator 28 extended from the end 24 thereof and bent or curved relative to the lever 20, and disengaged from the side flaps 21.

A cam member 30 and a bracket 40 are pivotally or rotatably attached to the side flaps 21 of the lever 20 with the pivot shaft 26, to allow the cam member 30 and the bracket 40 to be rotated relative to the side flaps 21 of the lever 20. The bracket 40 includes two rounded ears 41 extended from one end 42 thereof, for pivotally or rotatably attaching to the side flaps 21 of the lever 20 with the pivot shaft 26, and for preventing the ears 41 of the bracket 40 from being contacted with or actuated by the lever 20.

The bracket 40 further includes an end panel 43 extended from the other end 44 thereof, and preferably perpendicular to the bracket 40, and having a screw hole 45 formed therein for threading with a threaded shank 51 of a catch 50, which includes a curved hook 52 formed or provided on one end thereof for hooking or engaging with the keeper 92 of the panel member 91 (FIG. 3). A lock nut 53 may further be provided and threaded onto the threaded shank 51 of the catch 50, and engageable with the end panel 43 of the bracket 40 (FIGS. 3–6), for solidly or firmly locking the threaded shank 51 of the catch 50 to the bracket 40, and thus for allowing the catch 50 and the bracket 40 to be moved or rotated in concert relative to the lever 20.

It is preferable that the bracket 40 includes an opening 46 formed in an intermediate portion thereof for such as weight reducing purposes, or for allowing the threaded shank 51 of the catch 50 to be clearly seen through the opening 46 of the bracket 40, and thus for allowing the users to easily thread or adjust the threaded shank 51 of the catch 50 relative to the bracket 40 to the required position.

As shown in FIG. 1, the cam member 30 includes a U-shaped structure having two side plates 31 extended from a bottom plate 32, and preferably perpendicular to the bottom plate 32, and each of the side plates 31 includes an aperture 33 formed or provided in a rounded corner area 34 thereof for receiving the pivot shaft 26. The rounded corner areas 34 of the side plates 31 are each formed and defined between a horizontal surface 35 that is parallel to the bottom plate 32 and a vertical surface 36 that is perpendicular to the horizontal surface 35. The formation or the provision of the rounded corner areas 34 in the side plates 31 allows the cam member 30 to be rotated relative to the bracket 40, and allows the horizontal surface 35 of the cam member 30 to be engaged with the bracket 40 (FIGS. 3–6).

Figure 4:
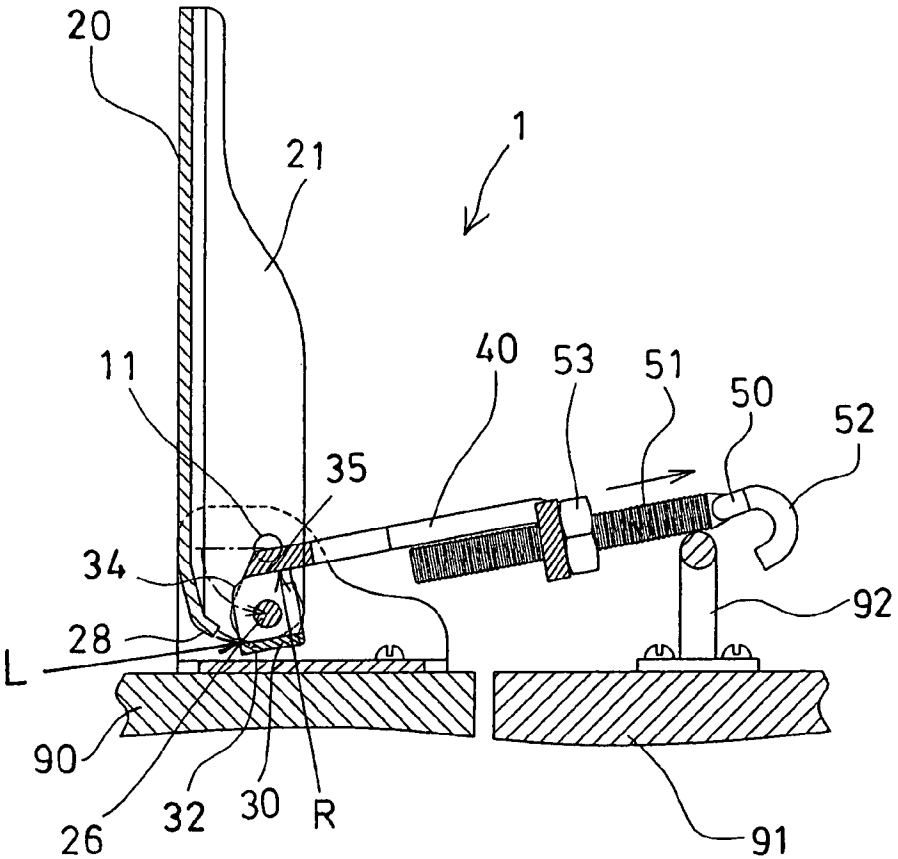
FIGS. 4, 5, 6 are partial cross sectional views similar to FIG. 3, illustrating the operation of the draw latch.
Figure 5:
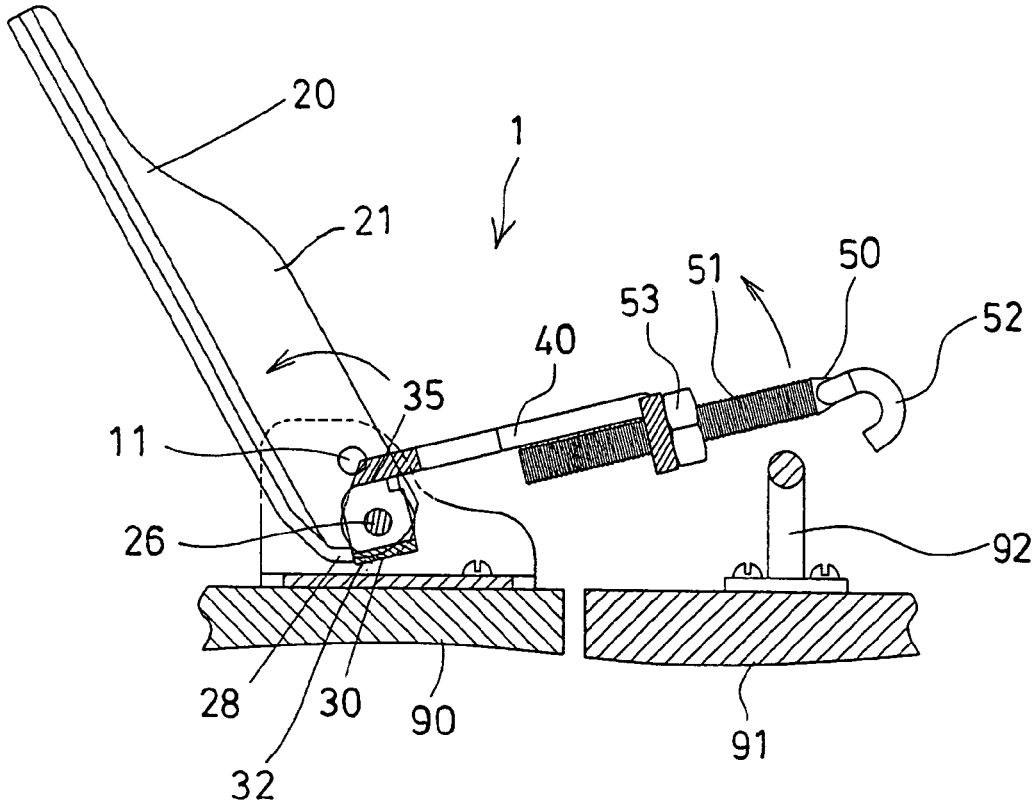

In operation, as shown in FIG. 4, when the lever 20 is lifted or rotated away from the base member 10 or the panel members 90, 91, the lever 20 may also be rotated relative to the cam member 30 and the bracket 40 until the actuator 28 of the lever 20 is contacted or engaged with the cam member 30 (FIG. 5). When the actuator 28 of the lever 20 is contacted or engaged with the cam member 30, both the cam member 30 and the bracket 40 may also be caused to be rotated away from the panel members 90, 91 by the lever 20 due to the engagement of the horizontal surface 35 of the cam member 30 with the bracket 40.

Figure 6:
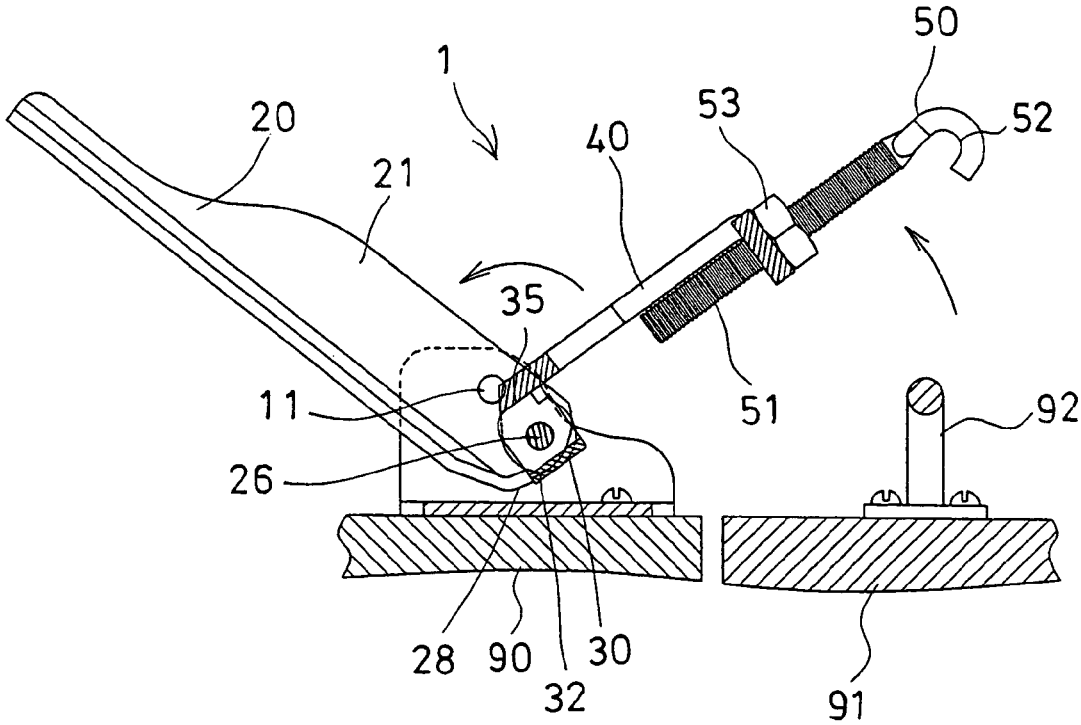

When the cam member 30 and the bracket 40 are rotated away from the panel members 90, 91 by the lever 20, the hook 52 of the catch 50 may also be caused or forced to move in a direction away from the keeper 92 of the panel member 91 (FIG. 4), and may also be caused or forced to rotate in a direction away from the keeper 92 of the panel member 91 (FIG. 5), to allow the cam member 30 and the bracket 40 to be rotated away from the panel members 90, 91 by the lever 20 (FIG. 6).

As also shown in FIG. 4, the engagement of the horizontal surface 35 of the cam member 30 with the bracket 40 allows the lever 20 to both act or to actuate onto the bracket 40 in a direction R that is perpendicular to the bracket 40 via the horizontal surface 35 of the cam member 30, and in another direction L that is parallel to the bracket 40 via the cam member 30, and thus to allow the cam member 30 and the bracket 40 to be easily rotated away from the panel members 90, 91 by the lever 20 with less force.

On the contrary, when it is required to lock or latch the panel members 90, 91 together, the cam member 30 and the bracket 40 may also be rotated toward the panel members 90, 91 by the lever 20 until the catch 50 is contacted or engaged with the keeper 92 of the panel member 91, when the lever 20 is rotated toward the panel members 90, 91. The hook 52 of the catch 50 may then be caused or forced to move in a direction to hook and to be secured to the keeper 92 of the panel member 91 when the lever 20 is further rotated toward the panel members 90, 91. The lever 20 may be secured or latched to the panel members 90, 91 by the base member 10 and the keeper 92 when the lever 20 is depressed toward and against the bracket 40 and the catch 50 (FIG. 3).

Accordingly, the draw latch in accordance with the present invention includes a catch that may be kicked out by a lever which may act or actuate onto the catch in both directions parallel to and perpendicular to the catch, to easily disengage the catch from a panel member and to separate the catch from the panel member with less force.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A draw latch for attaching to and for latching a first panel member and a second panel member together, said draw latch comprising:

a base member for securing to said first panel member, a keeper for securing to said second panel member, a lever rotatably attached to said base member with a pivot axle, said lever including two side flaps extended therefrom and parallel to each other and each having a hole formed therein for receiving said pivot axle, each of said side flaps includes a first end having an orifice formed therein for receiving a pivot shaft therein, and having an actuator extended from said first end thereof, a cam member and a bracket rotatably attached to said side flaps of said lever with said pivot shaft, to allow said cam member and said bracket to be rotated relative to said lever, said bracket including a first end having two ears extended therefrom for rotatably attaching to said side flaps of said lever with said pivot shaft, and including a second end having an end panel extended therefrom and having a screw hole formed in said end panel, a catch including a threaded shank threaded to said screw hole of said end panel, and including a hook provided on one end thereof for engaging with said keeper of said second panel member, and said cam member including a bottom plate, and two side plates extended from said bottom plate and each having an aperture formed in a corner area thereof, and each having a horizontal surface parallel to said bottom plate, and said horizontal surfaces of said side plates of said cam member being engageable with said bracket, to allow said actuator of said lever to actuate onto said cam member and then to actuate onto said bracket in a direction perpendicular to said bracket via said horizontal surfaces of said cam member.

2. The draw latch as claimed in claim 1, wherein said ears of said bracket are rounded to prevent said ears of said bracket from being actuated by said lever.

3. The draw latch as claimed in claim 1, wherein said first end of each of said side flaps includes a curved surface formed therein.

4. The draw latch as claimed in claim 1, wherein said catch includes a nut threaded onto said threaded shank and engageable with said end panel of said bracket, for locking said threaded shank of said catch to said bracket.

5. The draw latch as claimed in claim 1, wherein said bracket includes an opening formed therein for allowing said threaded shank of said catch to be seen through said opening of said bracket.

6. The draw latch as claimed in claim 1, wherein said actuator of said lever is offset from said side flaps thereof.

* * * * *